US010589149B2

(12) United States Patent
Tellam

(10) Patent No.: US 10,589,149 B2
(45) Date of Patent: Mar. 17, 2020

(54) EXERCISE DEVICE FOR ASSISTING WITH CERTAIN ABDOMINAL EXERCISES

(71) Applicant: Dylan Tellam, West Lebanon, NH (US)

(72) Inventor: Dylan Tellam, West Lebanon, NH (US)

(73) Assignee: Custom Product Innovations, Inc., Lebanon, IL (US)

( * ) Notice: Subject to any disclaimer, the term of this patent is extended or adjusted under 35 U.S.C. 154(b) by 90 days.

(21) Appl. No.: 15/848,272

(22) Filed: Dec. 20, 2017

(65) Prior Publication Data

US 2018/0169465 A1 Jun. 21, 2018

Related U.S. Application Data

(60) Provisional application No. 62/437,198, filed on Dec. 21, 2016.

(51) Int. Cl.

| | |
|---|---|
| ***A63B 23/02*** | (2006.01) |
| ***A63B 21/16*** | (2006.01) |
| ***A63B 21/00*** | (2006.01) |
| ***A63B 69/00*** | (2006.01) |

(52) U.S. Cl.

CPC ..... *A63B 23/0211* (2013.01); *A63B 21/1654* (2013.01); *A63B 21/4039* (2015.10); *A63B 69/0057* (2013.01); *A63B 2069/0062* (2013.01)

(58) Field of Classification Search

CPC .. A63B 23/02–0244; A63B 21/16–169; A63B 69/0057; A63B 2069/0062; A63B 21/4013; A63B 21/4015

USPC ..... 482/97, 121, 123

See application file for complete search history.

(56) References Cited

U.S. PATENT DOCUMENTS

| | | | | | |
|---|---|---|---|---|---|
| 258,146 | A * | 5/1882 | Smith | A63B 21/1627 | 482/40 |
| 2,050,652 | A * | 8/1936 | Fleming | A63B 23/0211 | 482/140 |
| 3,134,592 | A * | 5/1964 | Sharkey | A63B 23/0211 | 482/140 |
| 3,287,016 | A * | 11/1966 | Mayer | A63B 23/0211 | 297/310 |
| 4,185,816 | A * | 1/1980 | Bernstein | A63B 21/1645 | 482/140 |
| 4,230,313 | A * | 10/1980 | Chupp, Jr. | A63B 21/1654 | 482/140 |
| 4,468,022 | A * | 8/1984 | Wu | A63B 23/0211 | 482/140 |

(Continued)

*Primary Examiner* — Loan B Jimenez
*Assistant Examiner* — Kathleen Vermillera
(74) *Attorney, Agent, or Firm* — Sheehan Phinney Bass & Green PA

(57) ABSTRACT

A device to assist an exerciser in performing an abdominal exercise includes two rigid elements, a rigid cross member with a first end that is coupled to a first of the two rigid elements and a second end that is coupled to a second of the two rigid elements, and a soft material that defines a first surface coupled to a lower surface of the rigid cross member. Each rigid element is configured to define: a first portion that extends from a first end of the rigid element to a first bend, a second portion that extends from the first bend to a second bend that bends in a direction that is opposite the first bend, and a third portion that extends from the second bend to a second end of the rigid element. The first, second and third portions of the rigid element are substantially flat.

17 Claims, 16 Drawing Sheets

(56) References Cited

U.S. PATENT DOCUMENTS

| | | | | |
|---|---|---|---|---|
| 4,629,179 | A | 12/1986 | Bizilia | |
| 4,679,788 | A * | 7/1987 | Adler | A63B 21/0615 482/108 |
| 6,716,144 | B1 | 4/2004 | Shifferaw | |
| 7,043,799 | B2 * | 5/2006 | Moody | E05B 53/001 16/412 |
| 8,075,464 | B2 | 12/2011 | Hayes et al. | |
| 9,907,989 | B2 * | 3/2018 | Louviere | A63B 21/06 |
| 2005/0266971 | A1 * | 12/2005 | Nguyen | A63B 23/0211 482/140 |
| 2012/0208682 | A1 * | 8/2012 | Kueckelhan | A63B 23/0211 482/131 |
| 2013/0029814 | A1 * | 1/2013 | D'Alessandro | A63B 22/18 482/139 |

* cited by examiner

EXERCISE DEVICE FOR ASSISTING WITH CERTAIN ABDOMINAL EXERCISES

CROSS-REFERENCE TO RELATED APPLICATION(S)

This application claims the benefit of U.S. Provisional Patent Application Ser. No. 62/437,198, filed Dec. 21, 2016, entitled Exercise Device for Assisting with Certain Abdominal Exercises. The disclosure of the prior application is incorporated by reference herein in its entirety.

FIELD OF THE INVENTION

This disclosure relates to an exercise device and, more particularly, relates to an exercise device configured to assist an exerciser (e.g., by holding his or her feet down) to perform abdominal exercises (e.g., sit-ups).

BACKGROUND

Three cardinal workouts are push-ups, squats, and sit-ups. Push-ups and squats are easily done by yourself yet the vast majority of people require an assistant to perform a proper and effective sit-up. The assistant may assist the exerciser by holding down the exerciser's feet. This widely known issue has led to several apparatuses and attachments to secure a user's feet during exercise.

SUMMARY OF THE INVENTION

In one aspect, a device to assist an exerciser in performing an abdominal exercise, the device comprising two rigid elements, a rigid cross member with a first end that is coupled to a first of the two rigid elements and a second end that is coupled to a second of the two rigid elements, and a soft material that defines a first surface coupled to a lower surface of the rigid cross member. Each rigid element is configured to define: a first portion that extends from a first end of the rigid element to a first bend, a second portion that extends from the first bend to a second bend that bends in a direction that is opposite the first bend, and a third portion that extends from the second bend to a second end of the rigid element. The first, second and third portions of the rigid element are substantially flat.

In another aspect, a device to assist an exerciser in performing an abdominal exercise includes two rigid elements, a rigid cross member between 14 inches and 20 inches with a first end that is coupled to a first of the two rigid elements, and a second end that is coupled to a second of the two rigid elements, a soft material that defines a first surface coupled to a lower surface of the rigid cross member, wherein the soft material has a length between 14 inches and 20 inches, padding attached to a surface of the second portion on each of the rigid elements, openings in a distal part of a third portion of each rigid element to accommodate fasteners to fasten that rigid element to the rigid cross member, and a fastener (e.g., a screw or the like) in each of one or more of the openings to fasten a corresponding one of the rigid elements to the rigid cross member. Each rigid element is configured to define: a first portion that extends between 5 inches and 10 inches from a first end of the rigid element to a first bend that is between 75 and 105, where the first portion of the rigid element is substantially flat from the first end of the rigid element to the first bend; a second portion that extends between 3 inches and 8 inches from the first bend to a second bend that bends in a direction that is opposite the first bend between 60 degrees and 80 degrees, where the second portion of the rigid element is substantially flat from the first bend to the second bend; and a third portion that extends between 3 inches and 5 inches from the second bend to a second end of the rigid element, where the third portion of the rigid element is substantially flat from the first end of the rigid element to the second end. The two rigid elements are substantially identical and substantially parallel to each other.

In still another aspect, a method includes obtaining an exercise device as disclosed herein, sliding the substantially flat first portion of the device under a fixed (e.g., a door) or weighted (e.g., a bed) object, positioning the exerciser's feet underneath the rigid cross member with the soft material coupled to its lower surface; and performing one or more abdominal exercises with the exerciser's feet so positioned.

In yet another aspect, a device is disclosed that can assist an exerciser in performing an abdominal exercise, such as a sit-up, or the like. The device may include one or more rigid elements (e.g., flat bars, e.g., powder coated cold rolled steel or the like), where each rigid element is configured to define a flat first portion that can slide under an object, such as a mattress on the floor, a closed door, a box, or the like: a rigid cross member coupled to the one or more rigid elements; and a soft material, such as a polyethylene foam bun, coupled to a lower surface of the rigid cross member. Moreover, the device is configured such that, when each of the first flat portions has been slid under the object, the rigid cross member, with the soft material coupled to its lower surface, is presented slightly elevated from (and at a downward angle relative to) the floor with enough space beneath it to enable the exerciser to place his or her feet underneath the rigid cross member with the soft material coupled to its lower surface, wherein the soft material physically contacts the exerciser's feet and/or the exerciser's ankles when the exerciser's feet are positioned underneath the rigid cross member and soft material.

In another aspect, a method (of performing an abdominal exercise, such as a sit-up) includes obtaining the kind of device described in the foregoing paragraph; sliding the flat first portion of the device under an object, such as a closed door, a bed, a box, etc.; positioning an exerciser's feet underneath the rigid cross member with the soft material coupled to its lower surface; and having the exerciser perform one or more abdominal exercises, such as sit-ups or the like, with the exerciser's feet so positioned.

In some implementations, one or more of the following advantages are present: 1) simple and virtually effortless installation, 2) easy removability, 3) universality, 4) foam padding for comfort, and/or 5) allowing user to do reverse sit-ups (negatives), etc.

In some implementations, there may be other benefits. For example, while doing sit ups by yourself on a mat you generally move backwards after a while if your form gets sloppy and you end up using improper form. If while using the exercise device your form gets sloppy and you begin to move backwards the exercise device slides back as you do. This in turn will eventually halt the exercise device from functioning forcing you to reset it and reset your form. This effect keeps the user from exercising improperly limiting their risk of injury due to improper form. This is a function that generally cannot be achieved with fixed mount-type apparatuses.

In some implementations, even those who can perform sit-ups without assistance can still benefit from the exercise device and concepts disclosed herein (e.g., if attempting to perform a reverse (negative) sit-up—an exercise that generally cannot be done without foot support).

In some implementations, the disclosure provided herein provides for safety, comfort and convenience for the user. The technology in such implementations generally uses leverage to distribute force and weight allowing our device to function very effectively without the need of any external attachments or mounts (straps, clamps, screws etc.).

Other features and advantages will be apparent from the description and drawings, and from the claims.

BRIEF DESCRIPTION OF THE DRAWINGS

Like reference characters refer to like elements.

DETAILED DESCRIPTION

Figure 1:
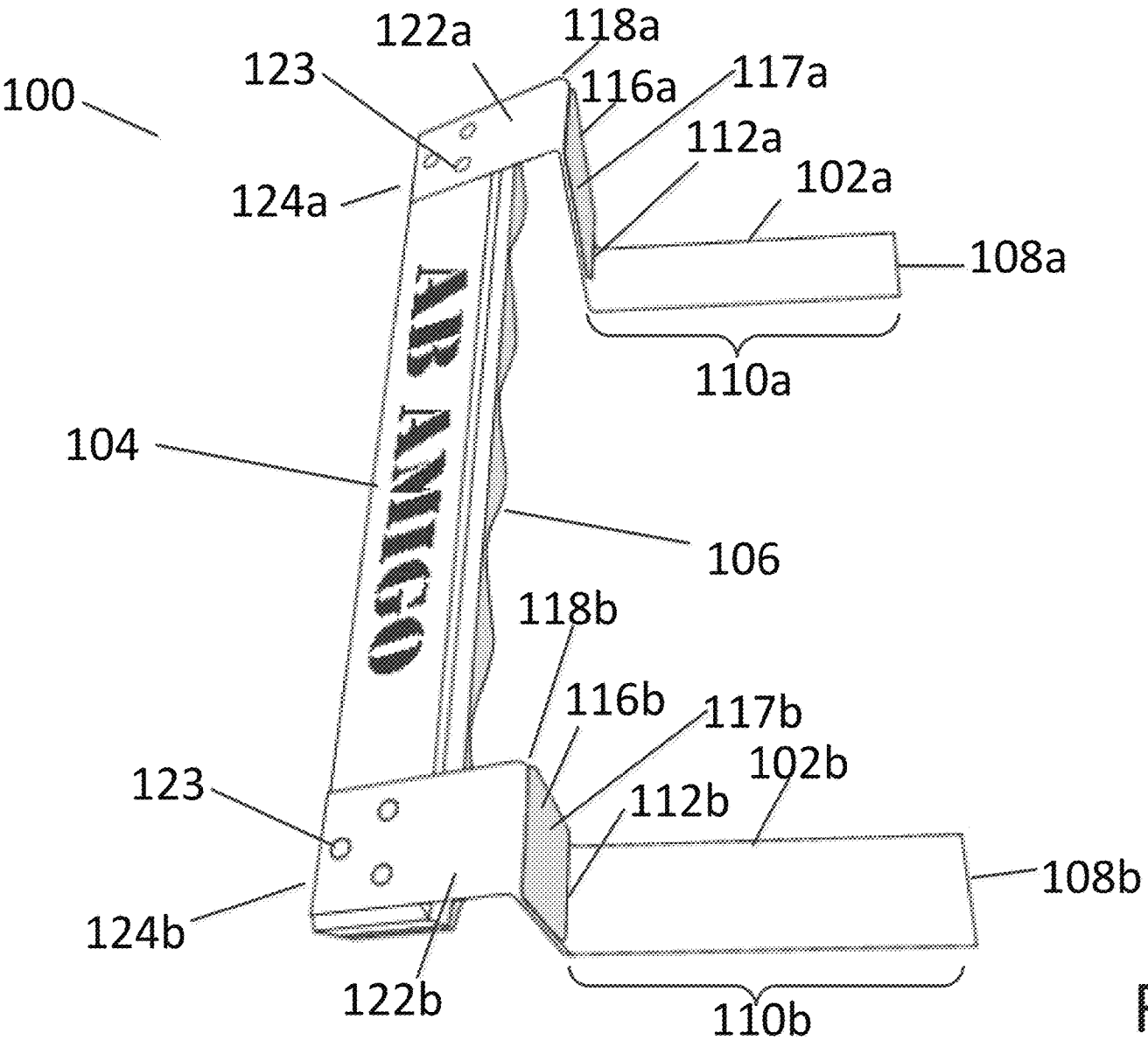
FIG. 1 is a perspective view of an exemplary exercise device.

The exemplary exercise device 100 (represented in FIGS. 1-13C, for example) is formed from two lengths of contoured flat bar 102*a*, 102*b*, a rigid cross member (made, e.g., of a piece of wood 104) that is connected to and extends between the two lengths of flat bar 102*a*, 102*b*, and a length of soft material (e.g., polyethylene foam bun 106) attached to and in physical contact with the piece of wood 104 (and, in some implementations, to each length of flat bar 102*a*, 102*b* as well). The components can be connected to each other in a variety of different ways including as shown in the attached figures, and there are a number of ways in which each of these connections can be made. In one example, the flat bar 102*a*, 102*b* is attached to the piece of wood using screws, and the polyethylene foam bun 106 is attached to the piece of wood 104 using an adhesive.

In the illustrated implementation, each length of flat bar 102*a*, 102*b* is shaped and shaped like the other and attached to the piece of wood 104 in such a manner that it is substantially parallel to the other (i.e., the lengths of flat bar 102*a*, 102*b* are side-by-side with the same distance continuously between them). In the exemplary implementation, each length of flat bar 102*a*, 102*b* is approximately 17 inches long, by 2 inches wide, by ⅛ of an inch thick.

Figure 14:
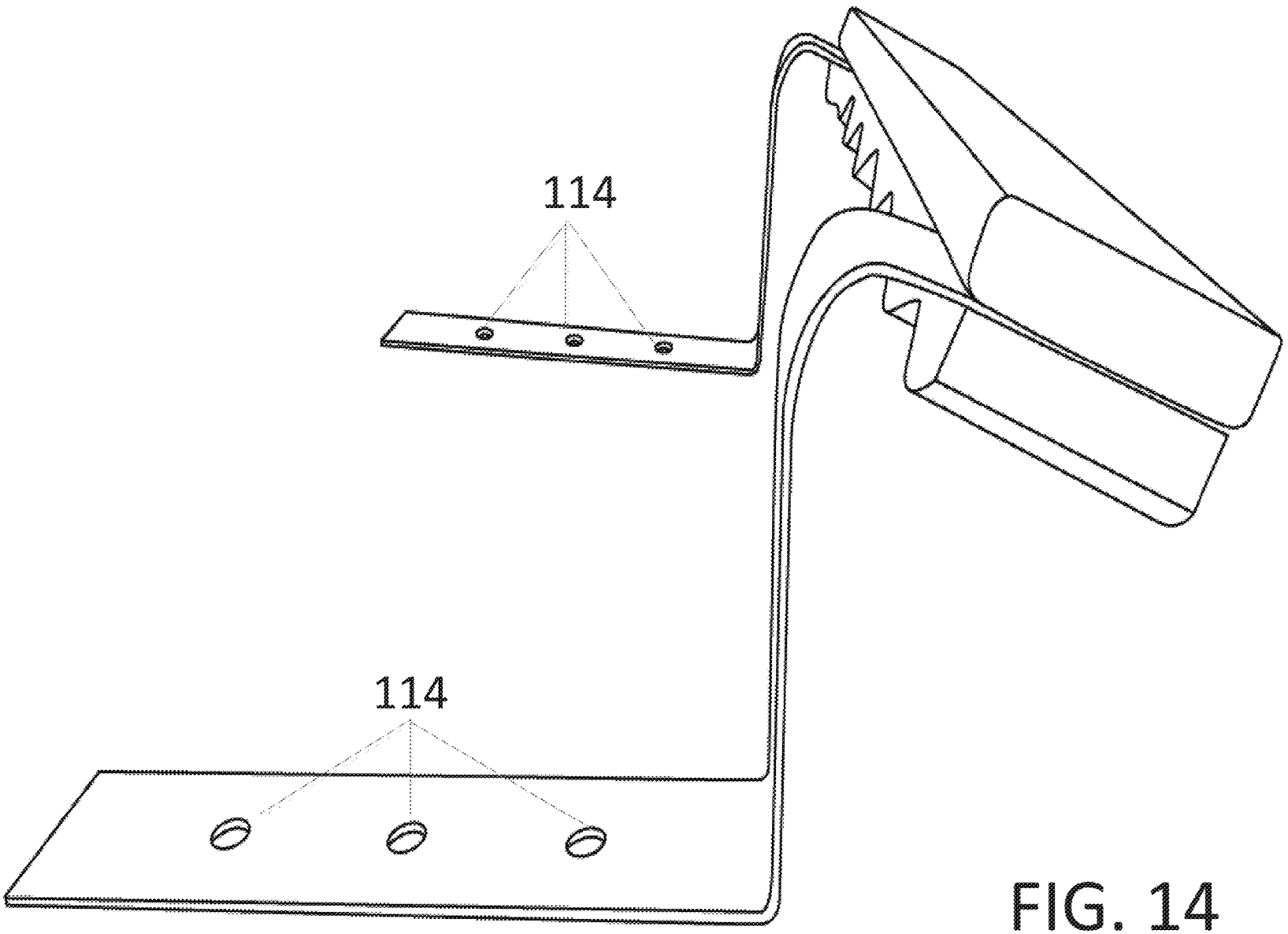
FIG. 14 is a perspective view of another exemplary exercise device.

In the illustrated implementation, each length of flat bar 102*a*, 102*b* has a first portion 110*a*, 110*b* that is substantially flat and configured to rest on the floor during use, for example. The first portion 110*a*, 110*b* of each length of flat bar 102*a*, 102*b* extends from a first end 108*a*, 108*b* of the length of flat bar 102*a*, 102*b* to a first, upward bend 112*a*, 112*b*. In the illustrated implementation, the first portion 110*a*, 110*b* of each length of flat bar 102*a*, 102*b* is flat from the first end 108*a*, 108*b* to the first, upward bend 112*a*, 112*b*. Moreover, in some implementation, there are openings 114 (not shown in FIG. 1 for example, but see FIG. 14) that extend through the first portion 110*a*, 110*b* of each length of flat bar 102*a*, 102*b* from an upper surface of the length of flat bar to a lower surface of the length of flat bar. In some implementations, these openings may accommodate screws that can be used to screw the product to a floor. The length of each first portion 110*a*, 110*b*, in the illustrated implementation, is approximately eight (8) inches (but can be between 6 and 10 inches, for example), and each of the first, upward bends 112*a*, 112*b*, in the illustrated implementation, is approximately 90 degrees (but can be, for example, between 75 and 105 degrees).

After the first, upward bend 112*a*, 112*b*, each length of flat bar 102*a*, 102*b* has a second portion 116*a*, 116*b* that extends from the first, upward bend 112*a*, 112*b*, in a substantially upward direction, to a second bend 118*a*, 118*b* that is in the opposite direction from the first bend 112*a*, 112*b*. The second portion 116*a*, 116*b* of each length of flat bar 102*a*, 102*b* is substantially flat from the first, upward bend 112*a*, 112*b* to the second, opposite bend 118*a*, 118*b*. In some implementations, there may be an opening or openings (not shown) that extend through the second portion 116*a*, 116*b* of each length of flat bar 102*a*, 102*b* from a first major surface of the length of flat bar to a second major surface of the length of flat bar opposite the first. That opening or those openings may accommodate fastening device(s) (e.g., screws or the like) to secure the exercise device 100 to a door or the like. The length of each second portion 116*a*, 116*b*, in the illustrated implementation, is approximately five (5) inches and each of the second, opposite bends 118*a*, 118*b*, in the illustrated implementation, is approximately 110 degrees (e.g., between 100 degrees and 120 degrees) to form an opposite angle of approximately 70 degrees (e.g., between 60 degrees and 80 degrees).

In the illustrated implementation, there is padding 117a, 117b attached (e.g., with an adhesive) to one surface of the second portion 116*a*, 116*b* on each length of flat bar 102*a*, 102*b*. Each piece of padding is substantially similar to the other. In a typical implementation, this padding may be the same material as the wave shape foam pad 106. In some implementations, this may be cross-linked polyethylene foam and may be backed with double sided tape for adhesion (or other type of adhesive). Exemplary dimensions for each piece of padding are as follows: width=2" (typically mimics, at least approximately, the width of flat bar), height=4" (but can be anywhere between 2" to 6"), and thickness=⅛" (but can be anywhere between 1/32" to ½"). The edges on the foam pad may be rounded slightly so if they are misplaced slightly a user will not notice any edges pointing out the sides.

After the second, opposite bend 118*a*, 118*b*, each length of flat bar 102*a*, 102*b* has a third portion 122*a*, 122*b* that extends from the second, opposite bend 118*a*, 118*b*, in a slightly downward direction (from the second opposite bend 118*a*, 118*b*), to a second end 124*a*, 124*b* of the length of flat bar 102*a*, 102*b*. The third portion 122*a*, 122*b* of each length of flat bar 102*a*, 102*b* is substantially flat from the second, opposite bend 118*a*, 118*b* to the second end 122*a*, 122*b* of the length of flat bar 102*a*, 102*b*. The length of each third portion 122*a*, 122*b*, in the illustrated implementation, is approximately four (4) inches (e.g., 3 inches to 5 inches).

A distal part of the third portion 122*a*, 122*b* of each length of flat bar 102*a*, 102*b* in the illustrated implementation contacts and is secured (with three screws) to an upper surface of the piece of wood 104. The flat bar in the illustrated implementation, extends over the piece of wood 104, which itself sits above the foam bun 106. In some implementations (not shown), the distal part of the third portion 122*a*, 122*b* of each length of flat bar 102*a*, 102*b* may extend between and be in contact with the piece of wood 104 and the foam bun 106, and attached to the wood with screws. In those implementations, the wood 104 may be on one side (i.e., the top) of the flat bar, and the foam bun 106 may be on an opposite side (i.e., the bottom) of the flat bar.

The piece of wood 104 in the illustrated implementation is a substantially flat. Moreover, the piece of wood 104 in the illustrated implementation has a length of approximately 17½ inches (e.g., 14 inches to 20 inches), a width of approximately 3 inches (e.g., 2 inches to 4 inches) and a height of approximately 1 inch (e.g., 0.5 inches to 2 inches). The lengths of flat bar 102*a*, 102*b* are coupled to opposite ends of the piece of wood 104. In some implementations, each length of flat bar is coupled at or very near an end of the piece of wood 104.

In some implementations (not shown), there may be two cavities formed (e.g., routed out) in the bottom (or top) surface of the piece of wood 104 (depending on the relative configuration of the flat bar to the wood) that align with the lengths of flat bar 102*a*, 102*b* and essentially provide for flush mounting of the flat bar 102*a*, 102*b* relative to the bottom (or top) surface of the wood 104. In those implementations (with cavities in the wood to accommodate the flat bar), the distal part of the third portion 122*a*, 122*b* of each of the flat bars 102*a*, 102*b* may be positioned within one of the cavities formed in the bottom (or top) surface of the wood 104. Each cavity may extend across the entire width (approximately 3 inches) of the bottom surface of the wood 104, with a depth that approximately matches the thickness of the flat bar (e.g., approximately ⅛ of an inch), and a width that matches, at least approximately, or is only slightly larger than the width of the flat bar (e.g., approximately 2 inches). In this kind of example, the distal part of the third portion 122*a*, 122*b* of each flat bar 102*a*, 102*b* may extend substantially across the entire width of the piece of wood (e.g., approximately 3 inches), substantially filling the cavity. Thus, the bottom (or top) surface of the distal part of the third portion 122*a*, 122*b* of each flat bar 102*a*, 102*b* may substantially flush to the bottom (or top) surface of the piece of wood 104.

In a typical implementation (e.g., as shown), there are openings 123 in the distal part of the third portion 122*a*, 122*b* of each length of flat bar 102*a*, 102*b* that extend from a first (upper) major surface of the flat bar to a second (lower) major surface of the flat bar opposite the first. These openings are provided and sized to accommodate fasteners (e.g., screws or the like) that can be used to fasten the lengths of flat bar to the piece of wood 104.

In a typical implementation, the foam bun 106 has a length that substantially matches the length of the piece of wood 104 (e.g., approximately 17½ inches) and width that is similar to, but generally a bit smaller than, the width of the piece of wood 104 (e.g., approximately 2 inches). The foam bun 106 typically has an upper surface that is substantially flat and a lower surface that may be contoured. The foam bun can have a thickness that is either substantially constant or varying (as shown) and may be anywhere from inch to 2 inches thick or more. The foam bun 106 shown in the attached figures has a lower surface that follows an undulating (sine-wave style) pattern from end-to-end across its length. In a typical implementation, the foam bun may be secured to the lower surface of the wood 104 and the lower surface of the flat bars 102*a*, 102*b* with an adhesive.

There is a product name—AB AMIGO—written on the upper surface of the piece of wood 104 in the illustrated implementation. In some implementations, this product name may be provided as a vinyl decal. Of course, the illustrated product name is only one of many possible product names for the exercise device 100. Virtually anything may appear on the upper surface of the piece of wood 104—a product name, an image, a piece of white board material (for writing goals, tracking sit-ups done, inspirational quotes, etc.), or any combination of these and/or other things. In some implementations, the upper surface of the piece of wood 104 may be blank.

Some of the figures (e.g., 2, 3, 4 and 11) show the exemplary exercise device 100 being used by an exerciser performing sit-ups.

Figure 2:
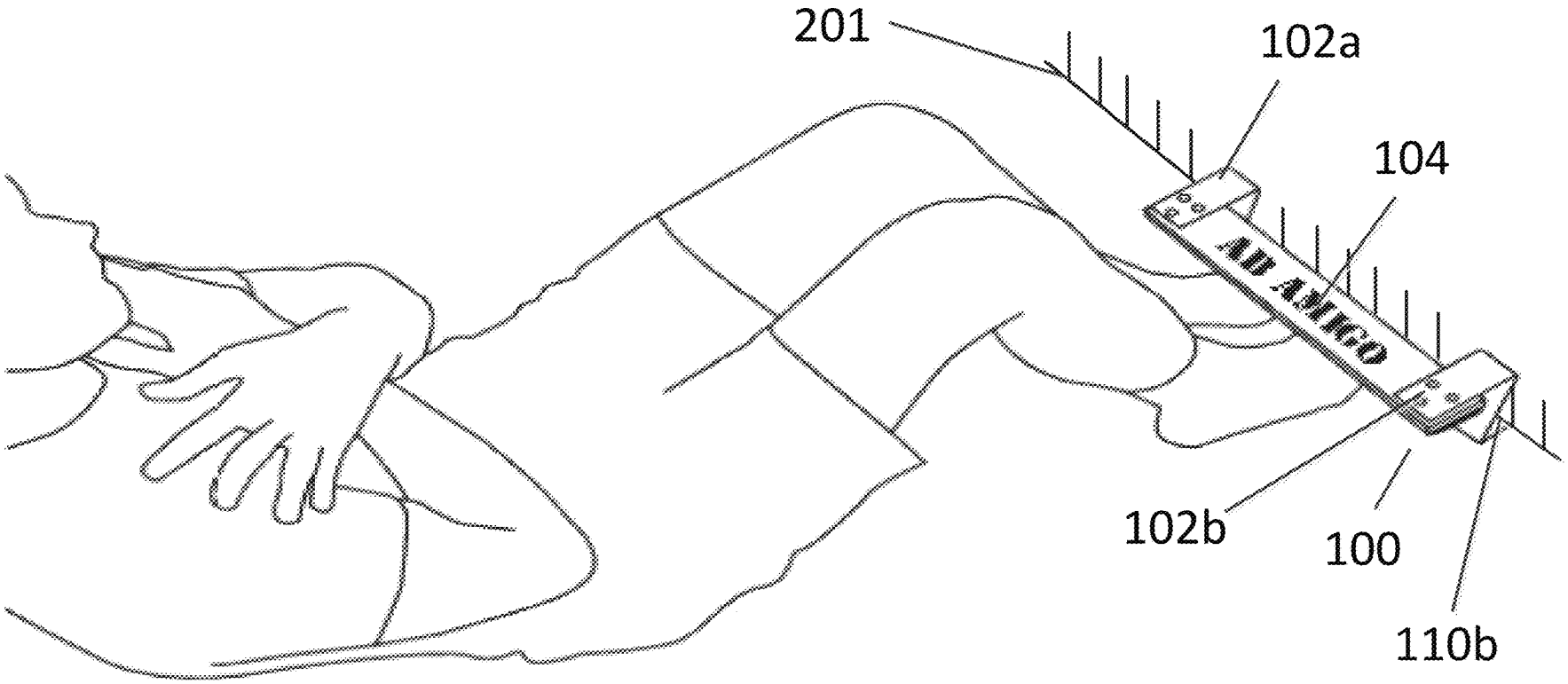
FIGS. 2 through 5 are views showing the exemplary exercise device in use.
Figure 3:
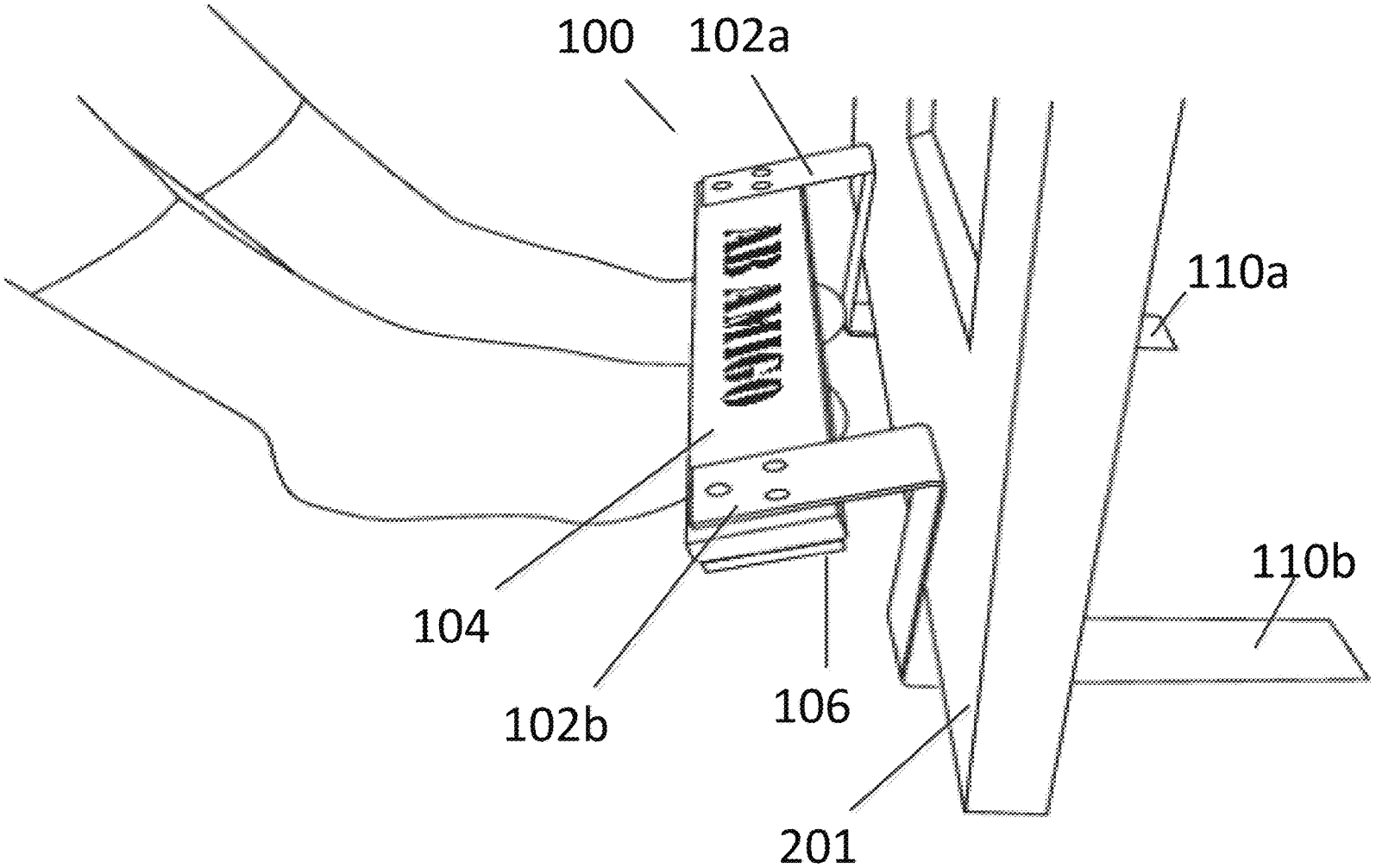
Figure 4:
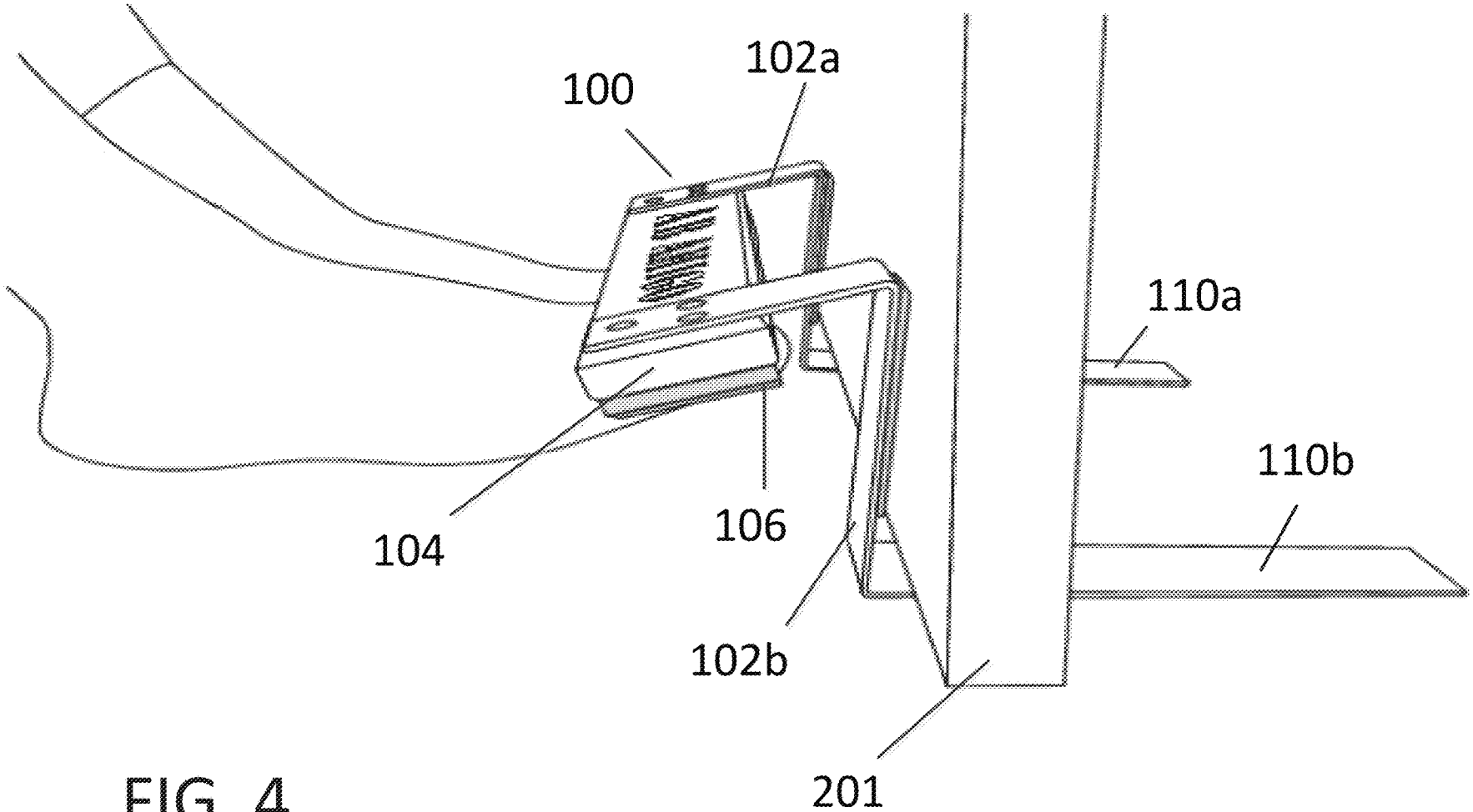
Figure 5:
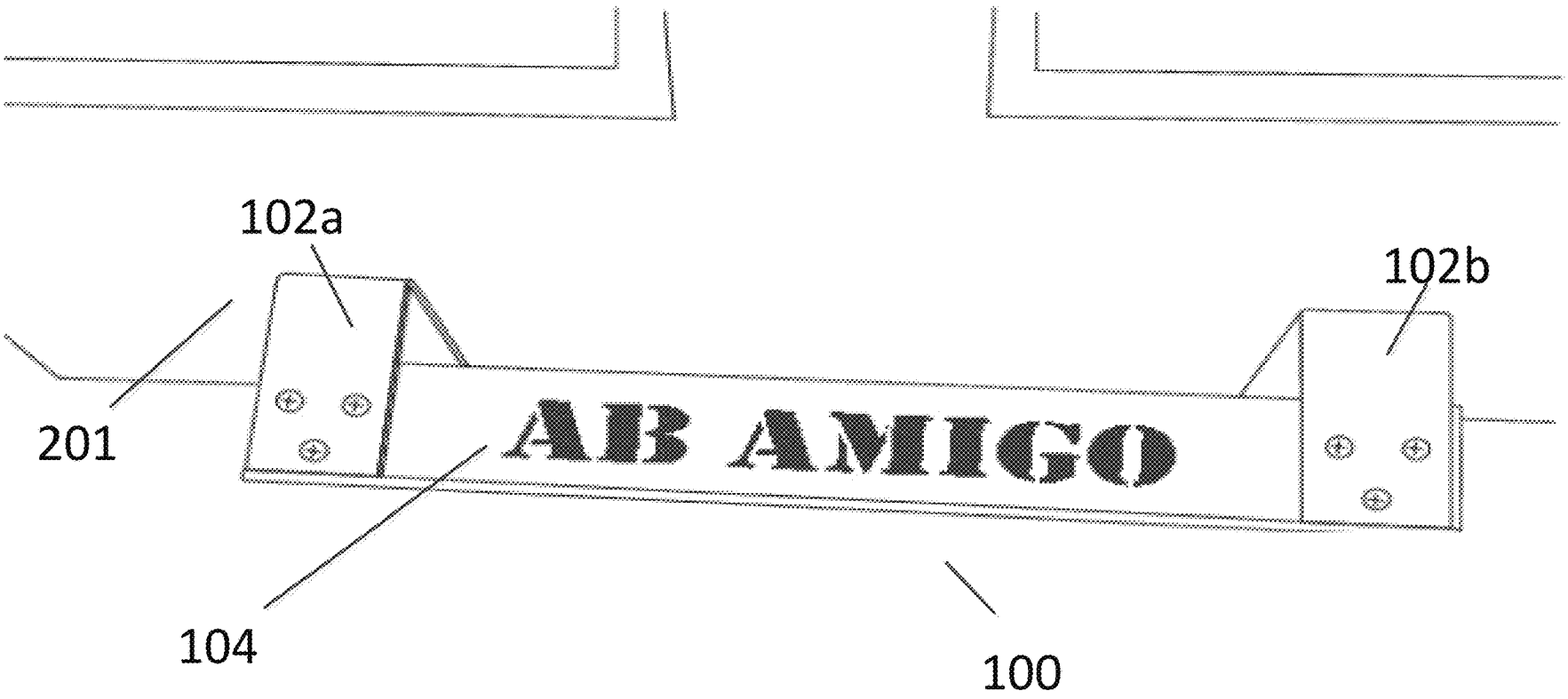
Figure 6:
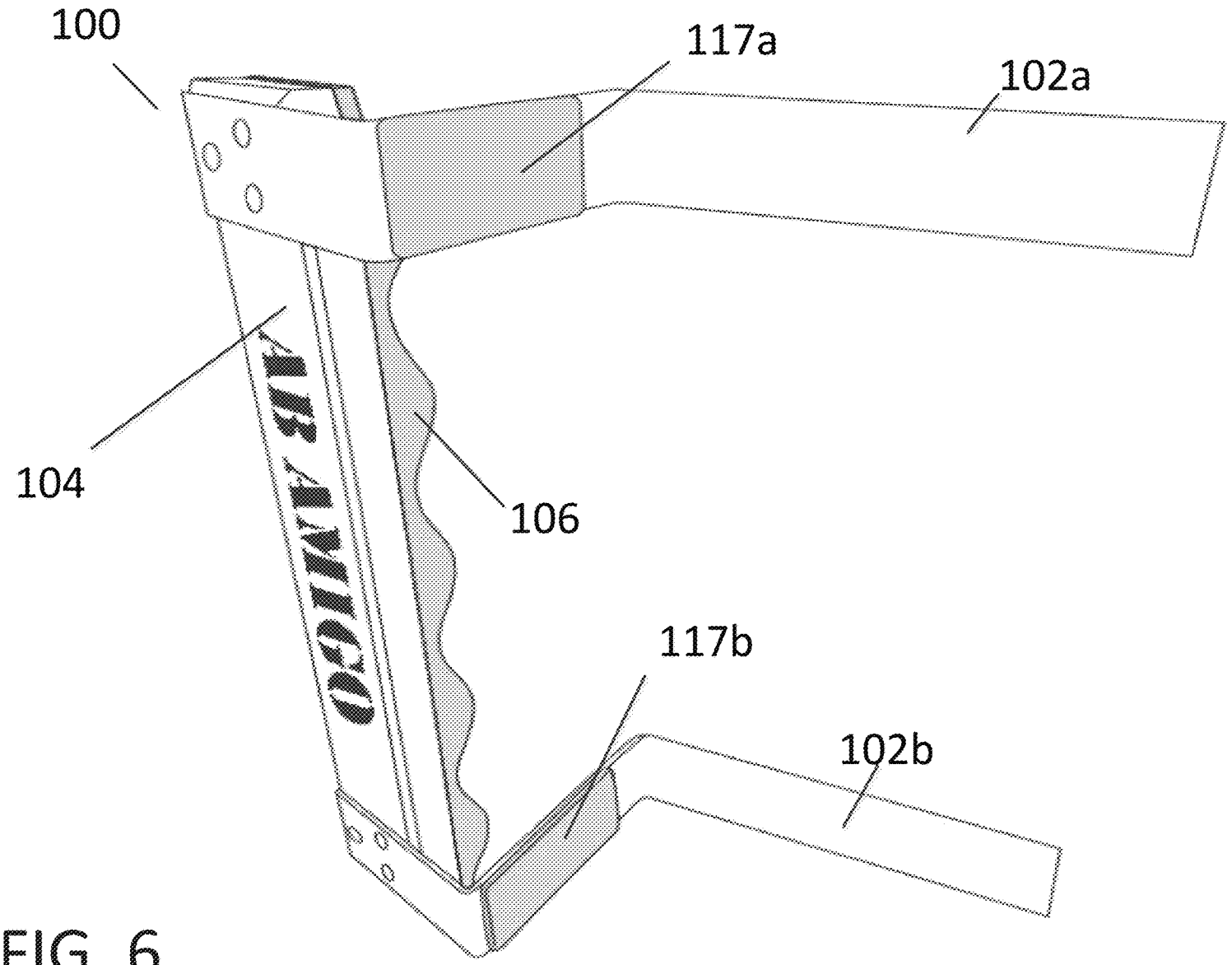
FIGS. 6 through 8 are additional perspective views of the exemplary exercise device.
Figure 7:
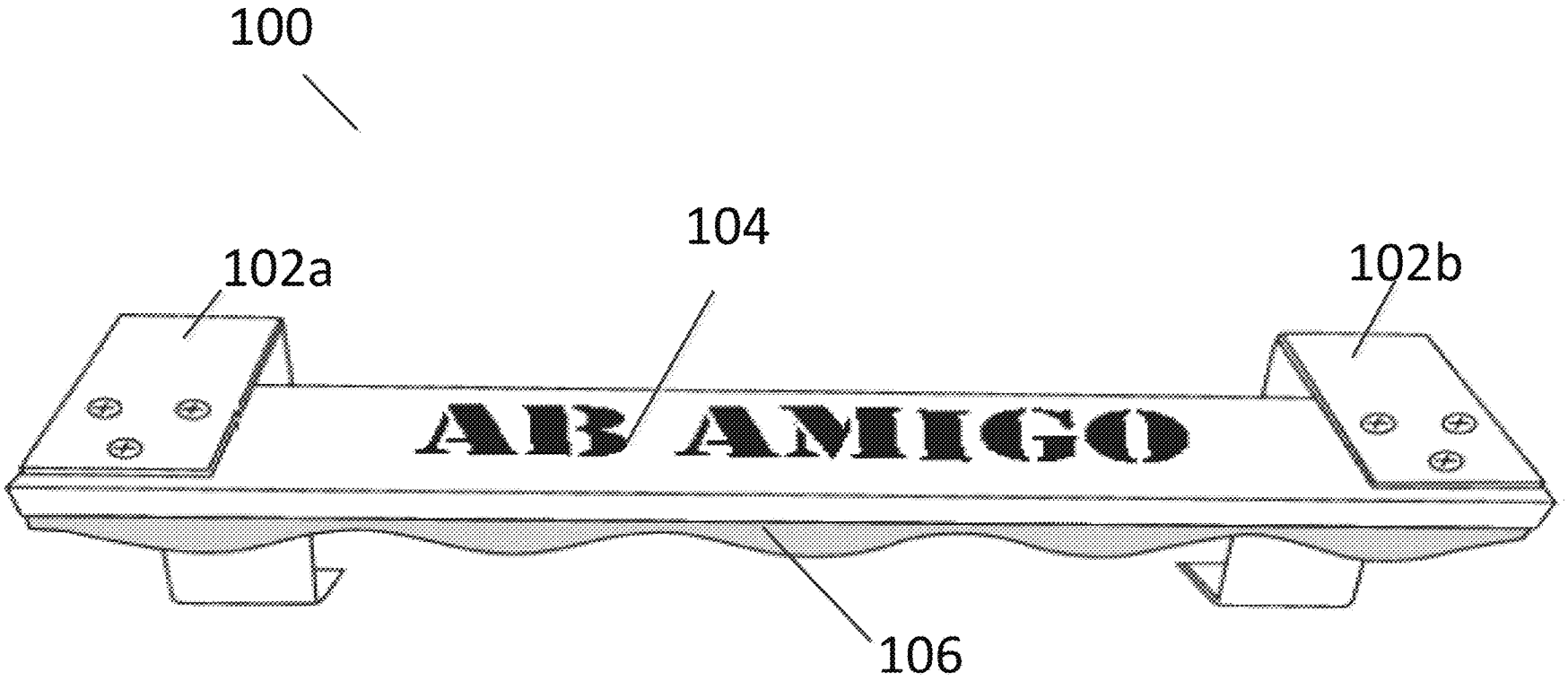
Figure 8:
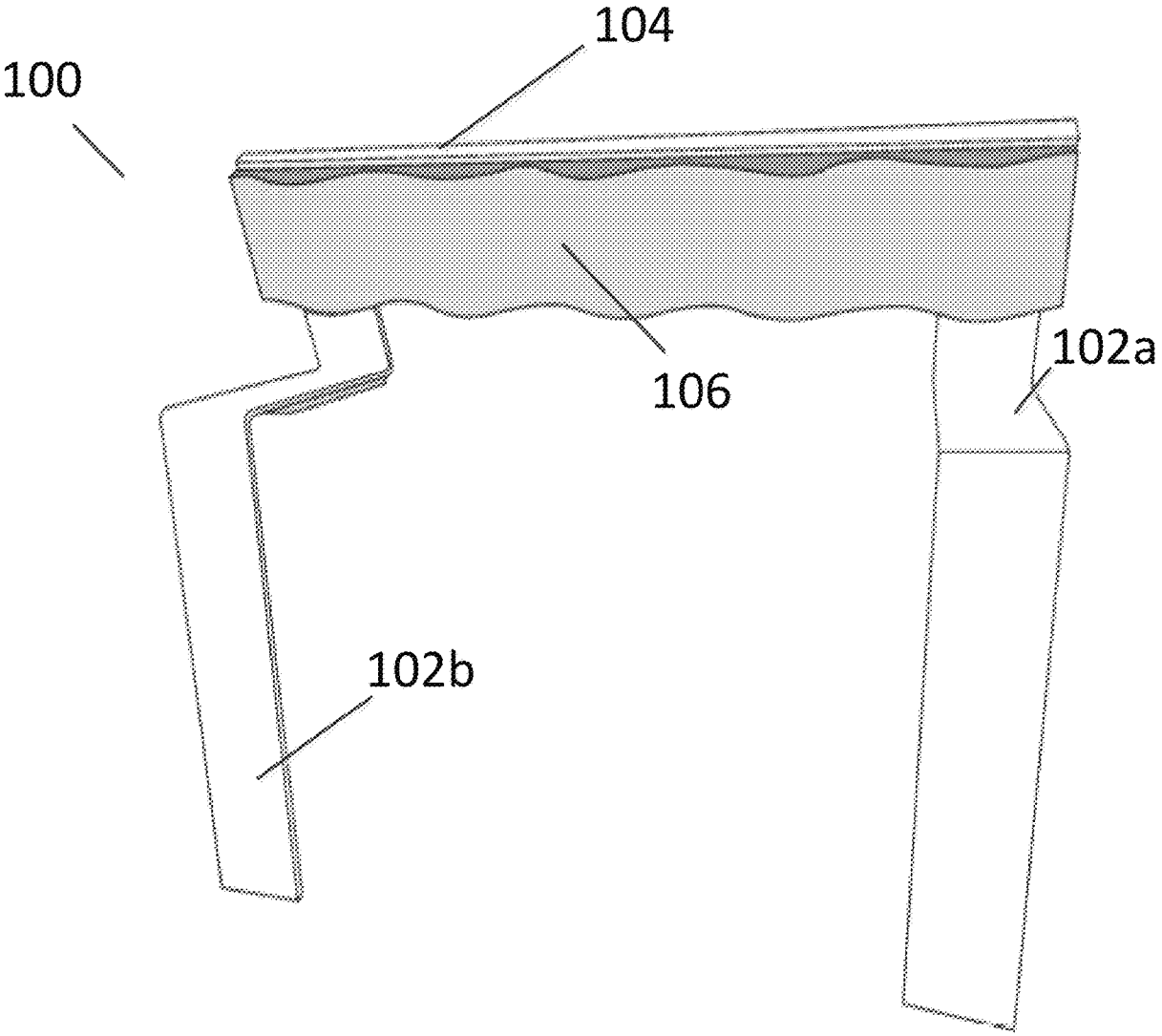
Figure 9:
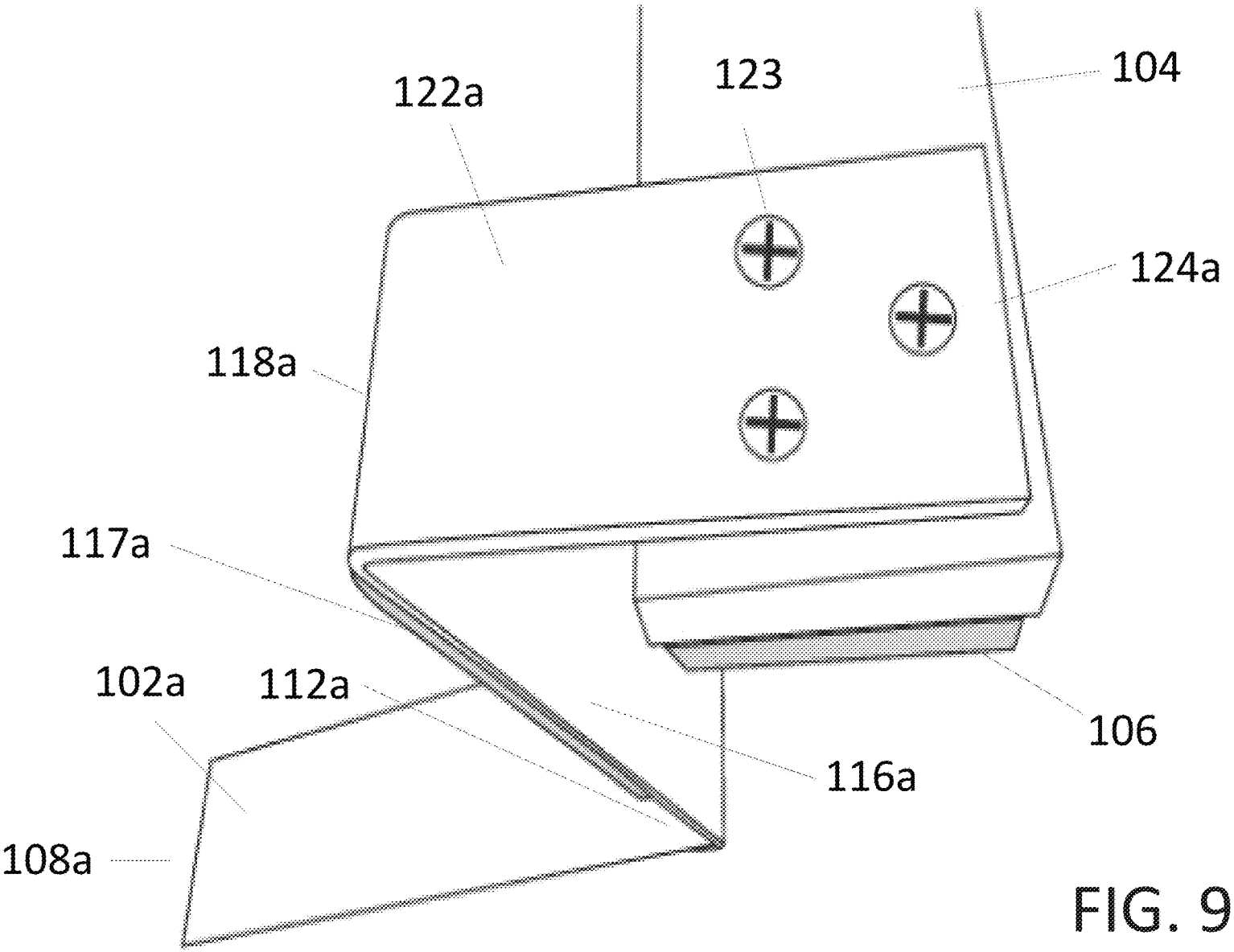
FIGS. 9 and 10 are partial perspective views of the exemplary exercise device.
Figure 10:
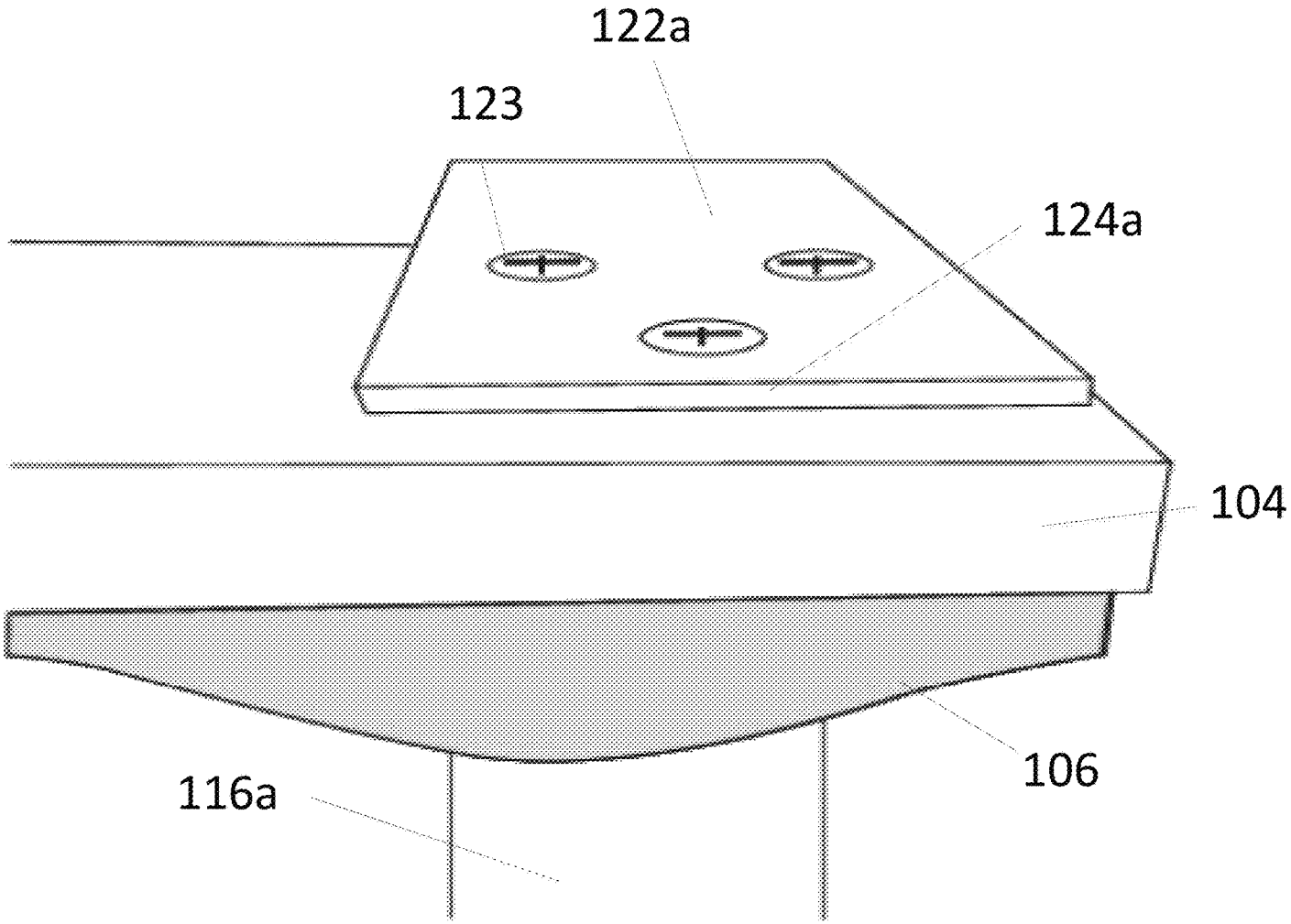
Figure 11:
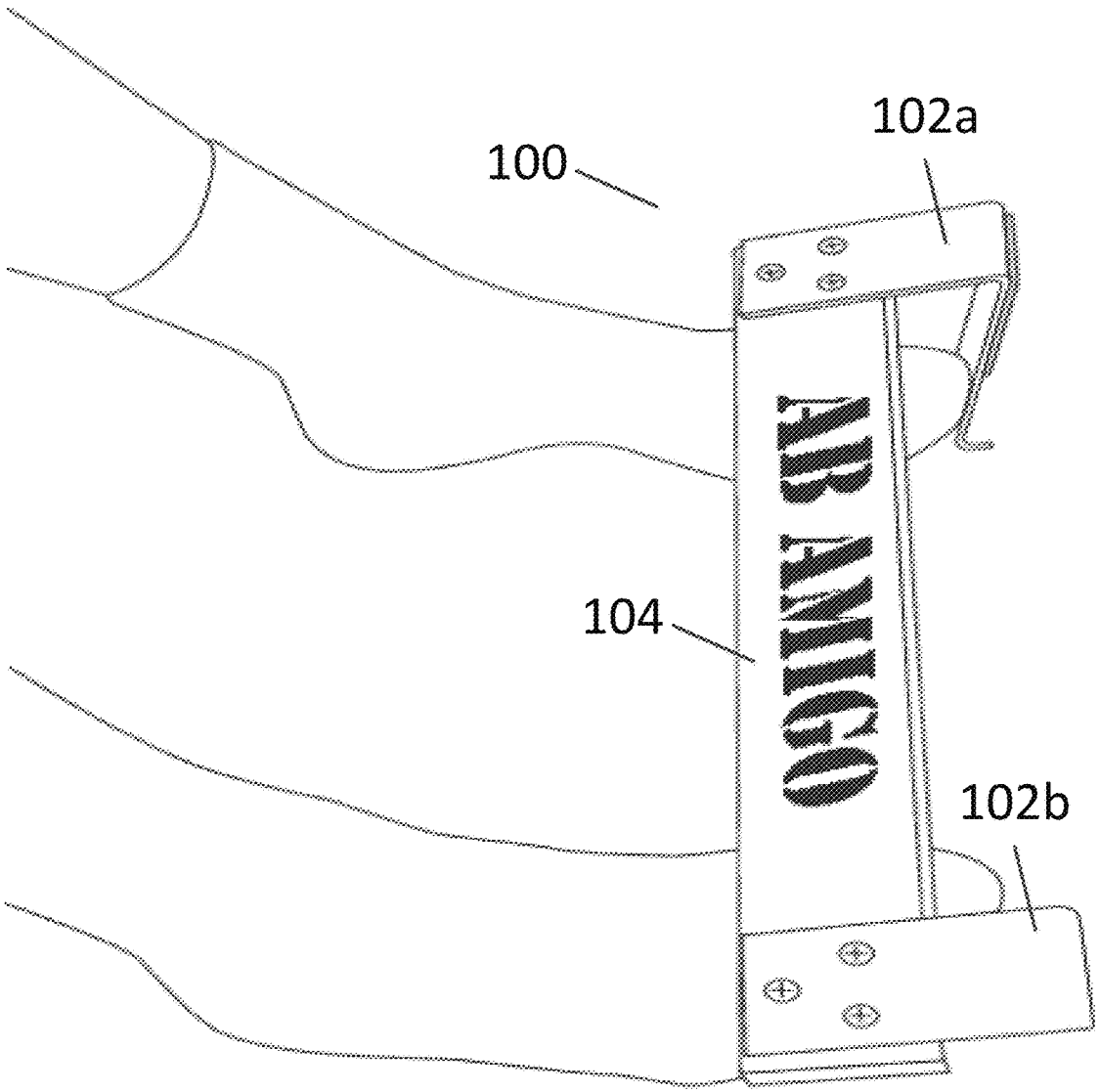
FIG. 11 is a partial view of the exemplary exercise device with a user's feet extended under the device.

As shown in these figures, in use, the exercise device 100 can be positioned so that at least part of the first portion 110*a*, 110*b* of each length of flat bar 102*a*, 102*b*) sits flat against the floor, extended under an object 201 that is either weighted (e.g., heavy enough to provide the necessary resistance for the exerciser to perform aided sit-ups (such as a bed, dresser, book case, or the like)), or fixed to resist or prevent movement in an upward direction to provide the necessary resistance for the exerciser to perform aided sit-ups (such as a door, or the like). When so positioned, the exercise device 100 presents the piece of wood 104 (and the foam bun 106 with its undulating lower surface) as shown—slightly elevated from (and at a downward angle relative to) the floor with enough space to accommodate (and hold in place) the exerciser's feet underneath it. More particularly, in this configuration, the foam bun 106 is beneath the piece of wood 104 so that when the exerciser places his or her feet under the piece of wood 104 and foam bun 106, the feet physically contact the lower undulating surface of the foam bun 106. This softness of the foam bun 106 provides comfort to the exerciser's feet, and the undulations help prevent side-to-side motion of the exerciser's feet during exercising. Moreover, with the exercise device 100 so positioned, when the exerciser puts his or her feet under the piece of wood (and foam bun 106) as shown, the exercise device 100 is able to hold the exerciser's feet down—even against the large forces that may be applied as the exerciser moves through the motions of doing a series of sit-ups. FIG. 2 shows the first portion 110*a*, 110*b* of the flat bars 102*a*, 102*b* extended under a bed, whereas FIGS. 3 through 5 show the first portion 110*a*, 110*b* of the flat bars 102*a*, 102*b* extended under a door.

Thus, in a typical implementation, the exercise device 100 can help a user perform proper sit-ups all alone (i.e., without the benefit of a human helper to hold down his or her feet).

In some implementations, there are other benefits as well. For example, for the typical exerciser, when doing sit ups alone on a mat he or she may inadvertently slide backwards after a while, particularly if the exerciser's form is or becomes sloppy; this sliding backwards can make the exerciser's form even more improper. If while using the exercise device 100, the exerciser's form gets sloppy and he or she begin to slide backwards the exercise device 100 may slide back with the exerciser. This in turn will eventually stop the exercise device 100 from working properly—forcing the exerciser to have to reset the exercise device 100 and reset his or her form. This effect can help prevent the exerciser from exercising improperly, thus making the exercising more effective and/or limiting the risk of injury due to improper form.

To be more particular, in a typical implementation, when using the exercise device 100, the exerciser's heel may act as an anchor to keep that exerciser's feet in place, but the problem may arise with the exerciser's tail bone. Similar to doing sit ups on a mat people have a tendency to bounce a little on their tail bone moving their rear end away from their heels. This creates a more obtuse angle in the person's legs than what they started with. In turn, to balance him- or herself, one basic reaction may be to use more leg muscles to help lift him or her up which pulls the bar ever so slightly out with each repetition. Hence improper form may pull the exercise device out ever so slightly from its flush position.

In a typical implementation, the exercise device 100 is believed to work best by using the approximately 90 degree bend as a fulcrum point. If the exercise device 100 were to slide out a few inches it creates more lift, which does not provide the same sturdy support that it provides if it is properly positioned. The exerciser may notice this change immediately and reset the exercise device 100. Generally speaking, if the exercise device moves toward the exerciser more than half the length of the first portion 110*a*, 110*b* it may no longer provide sufficient leverage and may just pull right out (e.g., from under the bed or door).

Moreover, the illustrated exercise device 100 was developed specifically for safety, comfort and convenience for the user. In a typical implementation, the device 100 uses leverage to distribute force and weight allowing the device to function effectively without the need of any attachments or mounts (straps, clamps, screws etc.).

It is worth noting that those who can perform sit-ups without assistance can still benefit from using the exercise device 100 when attempting to perform a reverse (i.e., negative) sit-up, for example. This is an exercise that cannot be done without the exerciser's foot being supported (i.e., held down).

Figure 15A:
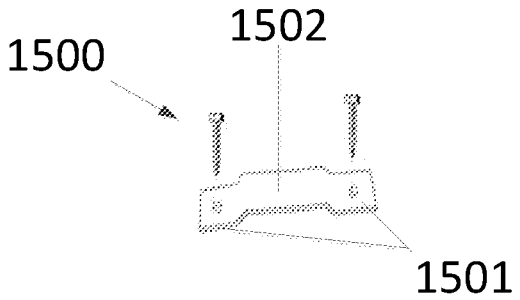
FIG. 15A is a perspective view of an exemplary bracket configuration that can be used to secure an exercise device to a surface (e.g., the floor).

FIG. 15A is a perspective view of an exemplary bracket 1500 configuration that can be used to secure an exercise device to a surface (e.g., the floor).

The illustrated bracket 1500 is made from a piece of flat rigid material (e.g., metal or the like) and contoured to define a pair of flat feet 1501 at opposite ends of the bracket and a raised midsection 1502. The bottoms of the feet lie in a common plane. The bracket is configured such that when the feet are in contact with a surface (e.g., the floor of a room), the raised mid-section is above that surface to define a space beneath the raised mid-section that can accommodate one of the first portions 110*a*, 110*b* of the flat bars 102*a*, 102*b* being slid underneath the raised mid-section. The bracket can have a variety of different dimensional configurations. In one exemplary dimensional configuration, the bracket is 1" wide, 5" long, and has a height at top of ½". Also shown in the illustrated figure is exemplary mounting hardware, which includes two screws that pass through holes in the foot portions of the bracket.

Figure 15B:
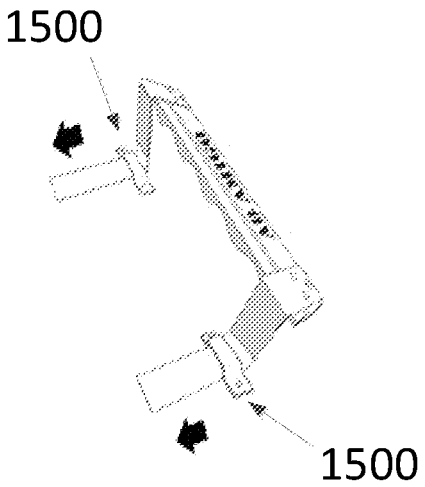
FIG. 15B is a perspective view of an exemplary exercise device secured to a surface with an exemplary bracket configuration.

FIG. 15B is a perspective view showing an exemplary exercise device (e.g., 100 of FIG. 1) secured to a surface (e.g., a floor of a room) with two exemplary brackets. The bracket is secured to the surface with a pair of screws (not shown) that pass through the openings in the feet of the brackets. The first portion of each flat bar has been slid under one of the raised portions of one of the brackets. To remove the exercise device, the exercise device can simply be slid out from under the bracket.

A number of embodiments of the invention have been described. Nevertheless, it will be understood that various modifications may be made without departing from the spirit and scope of the invention.

For example, a variety of different kinds of materials or combinations of materials can be used to manufacture any one or more of the various subcomponents (or portions of the subcomponents) of the exercise device. As an example, the flat bars can be virtually any kind of rigid material that can be shaped in a manner similar to the shape of the flat bar(s) shown and/or described herein, and able to perform in a similar manner to the flat bar(s) shown and/or described herein. As another example, the rigid cross member can be formed from wood or any other rigid material that is able to be shaped in a manner similar to the shape of the piece of wood shown and/or described herein, and able to perform in a similar manner to the piece of wood shown and/or described herein. Similarly, the soft material can be virtually any kind of soft material that can be shaped in a manner similar to the shape of the polyethylene foam bun shown and/or described herein, and able to perform in a similar manner to the polyethylene foam bun shown and/or described herein Likewise, some of the various subcomponents (or portions of the subcomponents) of the exercise device may be omitted entirely. For example, in some implementations, the exercise device may be provided with no soft material at all. Moreover, in some implementations, the two flat bars may be replaced with one flat bar and that one flat bar may have a width that extends substantially across an entirety of the exercise device. Alternatively, in some implementations, the two flat bars may be supplemented with a third (and potentially more) flat bar(s).

Additionally, in various implementations, other structural or functional features may be added to the exercise device. So, handles, counting mechanisms, timers, drink holders, and any one or more of a variety of other components (not shown in the figures) may be added to the device.

The various components may be fastened together using any one or more of a variety of fastening mechanisms (e.g., nuts and bolts, welds, nails, screws, adhesives, etc.).

Of course, the size (both relative and absolute), the shape and the relative configuration of the various subcomponents, and portions or the subcomponents, of the exercise device can vary significantly. For example, the first portion 110*a*, 110*b* of each length of flat bar 102*a*, 102*b* is described herein as being approximately eight (8) inches long and flat from end to end. However, in various implementations, this dimension may be anywhere from five (5) inches to eighteen (18) inches (e.g., 5-10 inches). Likewise, each of the first, upward bends 112*a*, 112*b* is described herein as being approximately 90 degrees. However, in various implementations, each of these bends 112*a*, 112*b* can be anywhere from 60 degrees to 110 degrees. Similarly, the a second portion 116*a*, 116*b* in each length of flat bar 102*a*, 102*b* is described herein as being approximately five (5) inches. However, in various implementations, this dimension can be anywhere from three (3) to twelve (12) inches (e.g., 3 to 8 inches). Moreover, the second, opposite bend 118*a*, 118*b* in each length of flat bar 102*a*, 102*b* is described herein as being approximately 110 degrees (to form an opposite angle of approximately 70 degrees). However, in various implementations, this second, opposite bend can be anywhere 100 degrees to 130 degrees (to form an opposite angle from 50 to 80 degrees). Also, the third portion 122*a*, 122*b* in each length of flat bar 102*a*, 102*b* is described herein as being approximately four (4) inches. However, in various implementations, this dimension can be anywhere from two (2) to eight (8) inches. Each length of flat bar 102*a*, 102*b* is described herein as having an overall length of approximately 17½ inches. However, in various implementations, that overall length can vary as well. Similarly, each length of flat bar 102*a*, 102*b* is described herein as having a width of approximately 3 inches. However, in various implementations, this dimension can vary from about 1 inch to about 17½ inches.

The piece of wood is described herein as being an approximately 17½ inch long by 3 inch wide by ⅛ inch thick piece of wood. These dimensions, too, can vary. For example, the 17½ inch length can be anywhere from about 6 inches to about 36 inches. The 3 inch dimension can vary, too (e.g., from approximately 1 inch to 10 inches). The ⅛ thickness can vary from approximately 1/32 of an inch to 1 inch. The soft material dimensions will generally be similar to the dimensions of whatever piece of wood it is attached to, so its dimensions, too, can vary.

The 2 inch width of the flat bar shown and disclosed herein can, in various implementations, be as little as 1 inch or as wide as 35 inches (as one piece instead of two).

In some implementations, the piece of wood may be replaced with (or covered by) a plastic composite coated with a white board coating allowing the user to use the face of the product as dry erase board. This may be used for the purpose of writing goals, motivational quotes, tally board to count workouts, etc.

The bottom surface of the soft material may be flat or may have any sort of repetitive or random varying pattern.

In a typical implementation, the exercise device can be, and is, used without securely fastening the exercise device to anything (e.g., a door, floor, bed, etc.). Despite no such fasteners being used, the exercise device works well. Thus, it is easy to use (e.g., install and remove) and simply constructed. That said, in some implementations, the device may be secured or fastened to nearby objects (e.g., doors, floors, beds, etc.) during use.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings and described herein as occurring in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

It should be understood that the relative terminology used herein, such as "top," "bottom," "upper", "lower", "above", "below", "front", "rear," "distal," "proximate," etc. is solely for the purposes of clarity and is not intended to limit the scope of what is described here to require particular positions and/or orientations. Accordingly, such relative terminology should not be construed to limit the scope of the present application.

The phrases sit-up or abdominal exercise or the like, as used herein, should be interpreted broadly to include any kind of abdominal exercise where the exerciser can benefit from placing his or her feet and/or ankles at least partially beneath the rigid cross member of the exercise device (secured under an object) and having them held in place (i.e., prevented from lifting far off the floor) by the exercise device. These may include, for example, basic sit-ups, crunches, side crunches, twist crunches, long arm crunches, reverse crunches, oblique crunches, circle obliques, etc.

In some implementations, the exercise device disclosed herein acts as a foot holding device that uses leverage to stay in place and creates a new and useful result by simulating the feeling of a real spotter holding your feet down. The exercise device, in a typical implementation, goes at least a step further than a human spotter. In this regard, the exercise device disclosed herein can keep that support to your feet contained in one direction—down rather than out. This keeps the exerciser from using their hip/leg muscles in lieu of their abdomen. This generally cannot be achieved with the excessive support given by a human spotter or otherwise.

In some implementations, the exercise device can be used with a custom bracket that one can slide the exercise device under. Essentially, the custom bracket would be a clip that can screw to the ground to create the perfect, or good, gap space.

In some implementations, the foam pattern simulates the feeling of two hands cuffing the exerciser's feet by its unique curved design.

In some implementations, the exercise device can be used by stacking weights (e.g., circular weights) on the flat portion of the legs to provide a desired amount of resistance. And overtime the exerciser can reduce the amount of weight until he no longer needed the product for support.

Figure 12A:
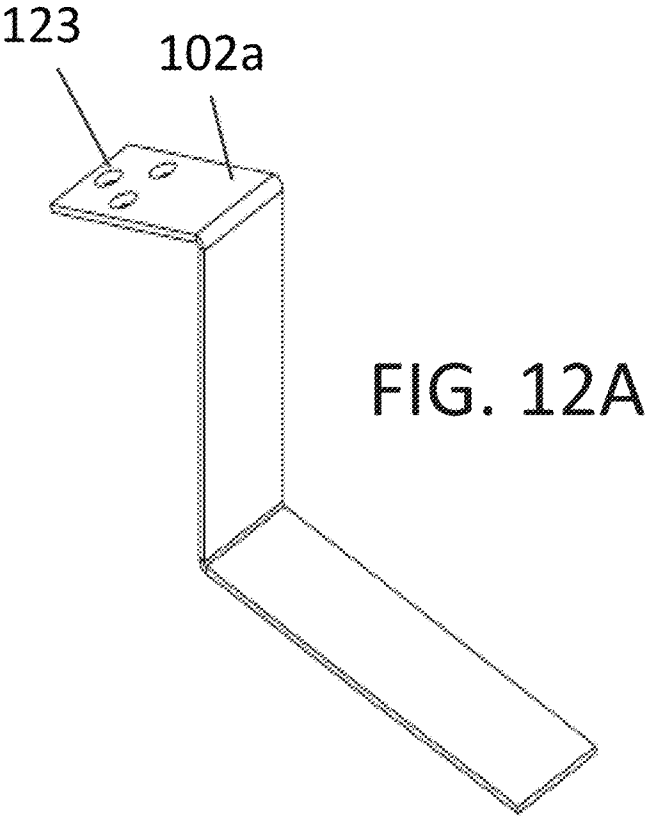
FIG. 12A is a perspective view of an exemplary length of flat bar contoured for use in the exemplary exercise device.
Figure 12B:
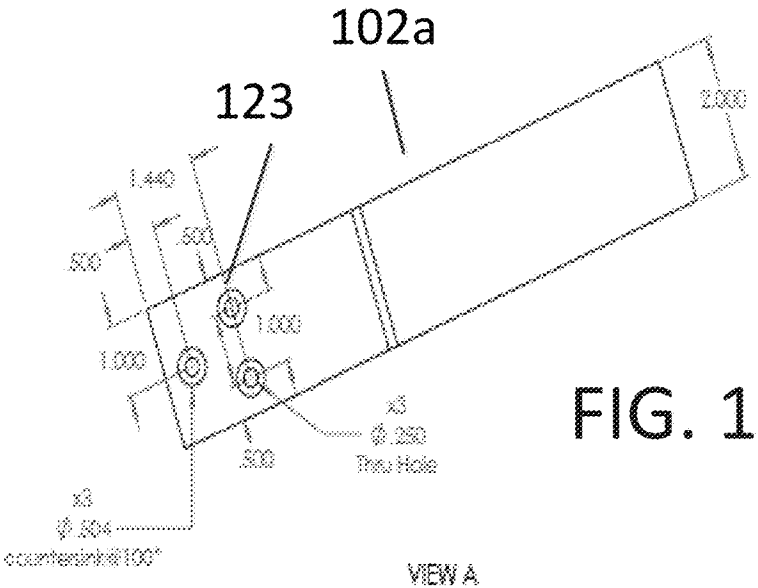
FIG. 12B is a top view of the exemplary length of flat bar in FIG. 12A, with dimensional information provided in inches.
Figure 12C:
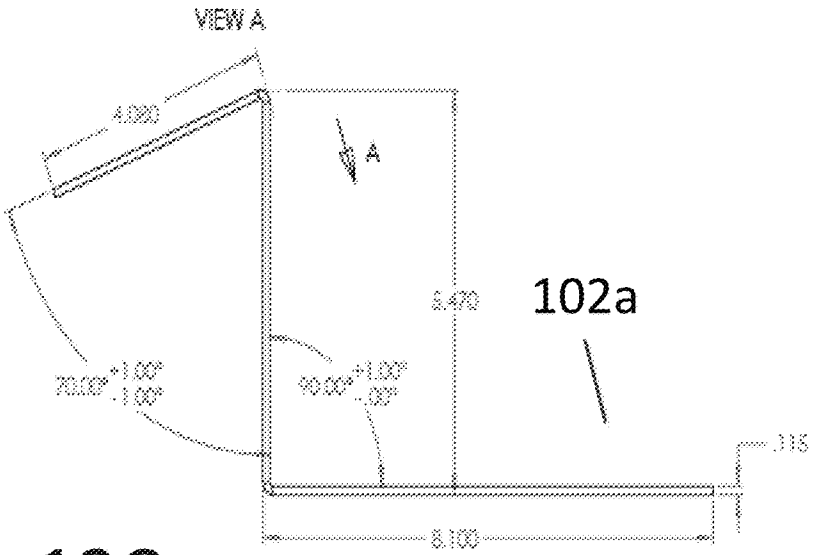
FIG. 12C is a side view of the exemplary length of flat bar in FIG. 12A, with dimensional information provided in inches.
Figure 13A:
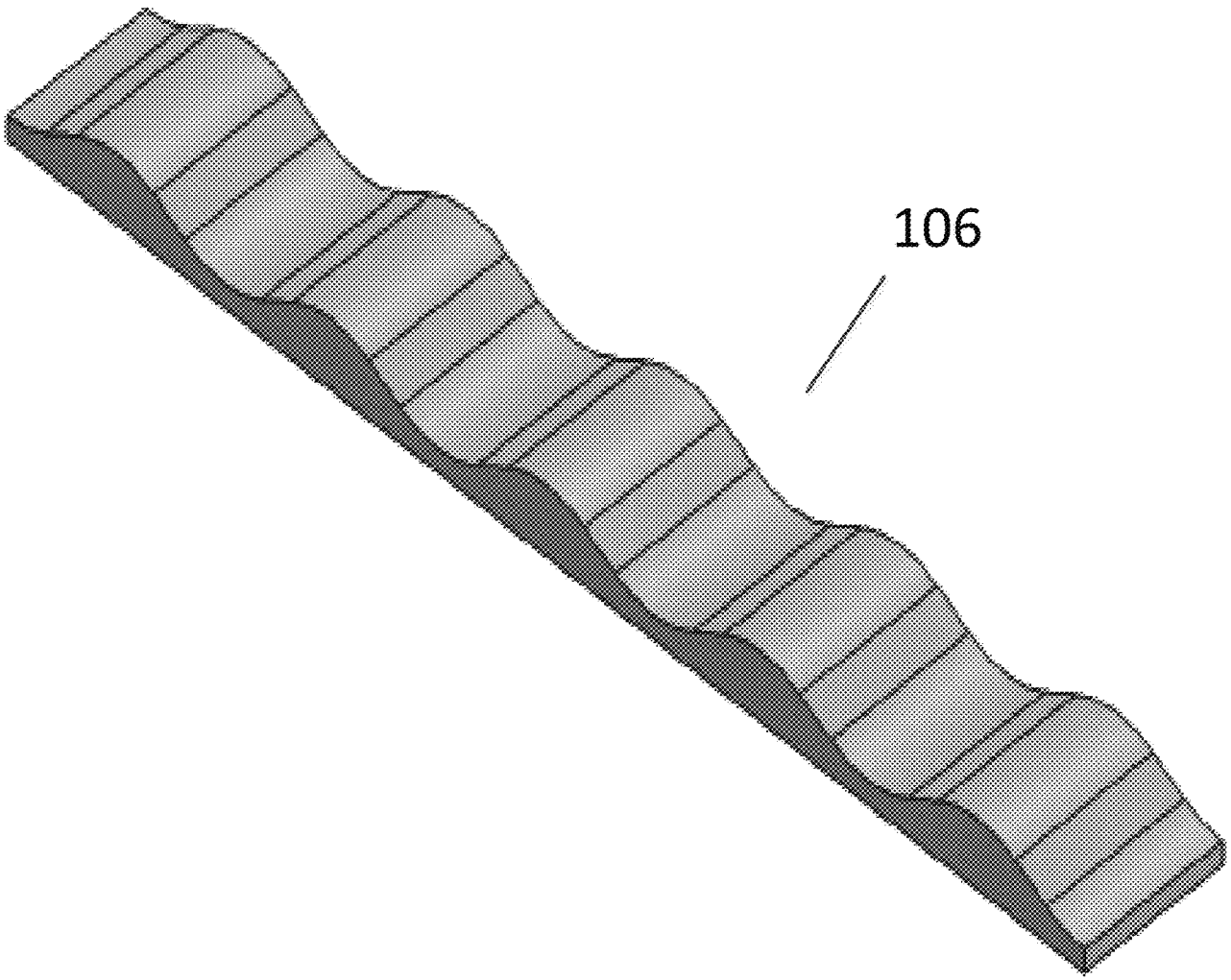
FIG. 13A is a perspective view of an exemplary piece of foam contoured for use in the exemplary exercise device.
Figure 13B:
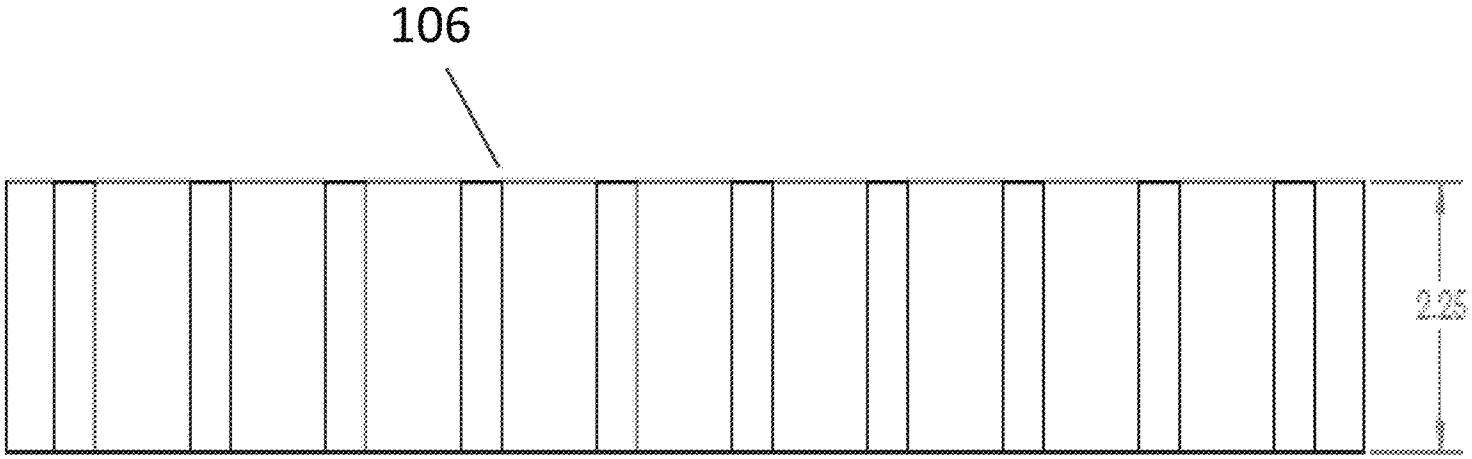
FIG. 13B is a top view of the exemplary piece of foam in FIG. 13A, with dimensional information provided in inches.
Figure 13C:
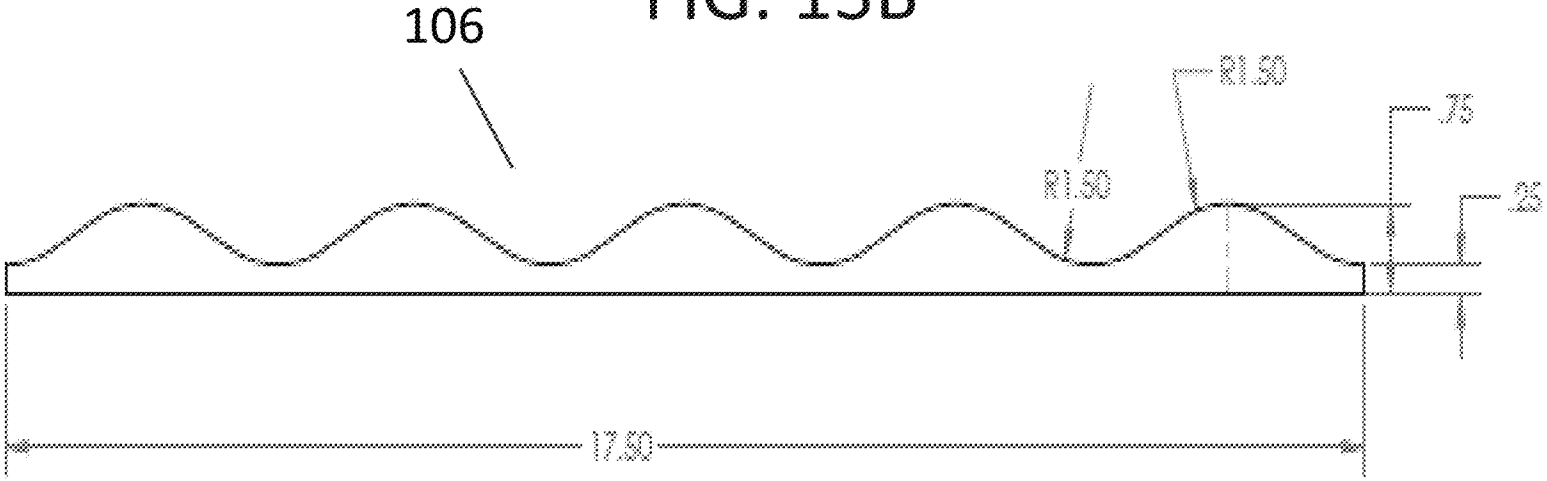
FIG. 13C is a side view of the exemplary piece of foam in FIG. 13A, with dimensional information provided in inches.

In some implementations, the tolerances associated with the dimensions provided in FIGS. 12B and 12C, for example, may be as follows: angle dimensions: +/−1 degree, two place decimals: 0.030 inches, and three place decimals: 0.015 inches. In some implementations, the tolerances associated with the dimensions provided in FIGS. 13B and 13C may be as follows: +/−0.030 inches.

Finally, the phrase substantially, as used herein, should be construed broadly to mean being largely or wholly that which is specified. So if, for example, some portion of the exercise device is described herein as being substantially flat, it should be understood that the portion is either completely flat (e.g., having major surfaces essentially parallel and distinctly greater than the minor surfaces) or very close to flat (e.g., within typical manufacturing tolerances).

Other implementations are within the scope of the claims.

What is claimed is:

1. A device to assist an exerciser in performing an abdominal exercise, the device comprising:

two rigid elements, wherein each rigid element is configured to define:

a first portion that extends from a first end of the rigid element to a first bend, wherein the first portion of the rigid element is substantially flat from the first end of the rigid element to the first bend;

a second portion that extends from the first bend to a second bend that bends in a direction that is opposite the first bend, wherein the second portion of the rigid element is substantially flat from the first bend to the second bend; and a third portion that extends from the second bend to a second end of the rigid element, wherein the third portion of the rigid element is substantially flat from the first end of the rigid element to the second end, a rigid cross member with a first end that is coupled to the third portion of a first of the two rigid elements, and a second end that is coupled to the third portion of a second of the two rigid elements; and a soft material that defines a first surface coupled to a lower surface of the rigid cross member, wherein, in each rigid element:

the first portion is between 5 inches and 10 inches long;

the first bend is between 75 degrees and 105 degrees;

the second portion is between 3 inches and 8 inches long;

the second bend is between 60 degrees and 80 degrees; and the third portion is between 3 inches and 5 inches long.

2. The device of claim 1, configured such that when the first portion of both rigid elements is in contact with a flat surface, the rigid cross member, with the soft material coupled to the lower surface of the rigid cross member, is presented elevated above the flat surface with enough space between the soft material and the flat surface to enable the exerciser to place his or her feet and/or ankles at least partially between the rigid cross member and the flat surface.

3. The device of claim 2, wherein the soft material physically is configured so as to contact the exerciser's feet and/or the exerciser's ankles when the exerciser's feet and/or ankles are positioned at least partially between the soft material on the rigid cross member and the flat surface, and the exerciser is performing a sit-up or other abdominal exercise on the flat surface.

4. The device of claim 1, wherein the substantially flat first portion of each rigid element is configured to slide along a flat surface under an object that is either weighted or fixed to resist movement by the substantially flat first portion of each rigid element in a direction away from the flat surface.

5. The device of claim 1, wherein the two rigid elements are substantially identical.

6. The device of claim 1, wherein the two rigid elements are substantially parallel to each other.

7. The device of claim 1, wherein the rigid cross member has a length between 14 inches and 20 inches.

8. The device of claim 1, wherein the soft material has a length between 14 inches and 20 inches.

9. The device of claim 1, wherein the two rigid elements are metal, the rigid cross member is wood, and the soft material is a polyethylene foam.

10. The device of claim 1, wherein the soft material defines a second surface, opposite the first surface, and wherein the second surface is contoured to follow an undulating pattern from end-to-end across a length of the soft material.

11. The device of claim 1, further comprising padding attached to a surface of the second portion of each rigid element.

12. The device of claim 1, further comprising:

openings in a distal part of the third portion of each rigid element to accommodate fasteners to fasten each rigid element to the rigid cross member.

13. The device of claim 12, further comprising:

a fastener in each of the openings to fasten a corresponding one of the rigid elements to the rigid cross member.

14. The device of claim 1, further comprising:

a bracket attached to a flat surface, wherein the bracket is contoured to define a pair of flat feet at opposite ends of the bracket and a raised mid-section between the feet, and wherein the first portion of each rigid element is configured so that it can slide underneath the raised mid-section of the bracket.

15. A method comprising:

obtaining the device of claim 1;

sliding the substantially flat first portion of the device under a fixed or weighted object;

positioning the exerciser's feet underneath the rigid cross member with the soft material coupled to its lower surface; and performing one or more abdominal exercises with the exerciser's feet so positioned.

16. A device to assist an exerciser in performing an abdominal exercise, the device comprising:

two rigid elements, wherein each rigid element is configured to define:

a first portion that extends between 5 inches and 10 inches from a first end of the rigid element to a first bend that is between 75 degrees and 105 degrees, wherein the first portion of the rigid element is substantially flat from the first end of the rigid element to the first bend;

a second portion that extends between 3 inches and 8 inches from the first bend to a second bend that bends in a direction that is opposite the first bend between 60 degrees and 80 degrees, wherein the second portion of the rigid element is substantially flat from the first bend to the second bend; and a third portion that extends between 3 inches and 5 inches from the second bend to a second end of the rigid element, wherein the third portion of the rigid element is substantially flat from the first end of the rigid element to the second end, wherein the two rigid elements are substantially identical and substantially parallel to each other, a rigid cross member that has a length between 14 inches and 20 inches and with a first end that is coupled to the third portion of a first of the two rigid elements, and a second end that is coupled to the third portion of a second of the two rigid elements;

a soft material that defines a first surface coupled to a lower surface of the rigid cross member, wherein the soft material has a length between 14 inches and 20 inches;

padding attached to a surface of the second portion on each of the rigid elements;

openings in a distal part of the third portion of each rigid element; and fasteners in the openings in the distal part of the third portion of each rigid element to fasten the rigid elements to the rigid cross member.

17. A device to assist an exerciser in performing an abdominal exercise, the device comprising:

two rigid elements, wherein each rigid element is configured to define:

a first portion that extends from a first end of the rigid element to a first bend, wherein the first portion of the rigid element is substantially flat from the first end of the rigid element to the first bend;

a second portion that extends from the first bend to a second bend that bends in a direction that is opposite the first bend, wherein the second portion of the rigid element is substantially flat from the first bend to the second bend; and a third portion that extends from the second bend to a second end of the rigid element, wherein the third portion of the rigid element is substantially flat from the first end of the rigid element to the second end, a rigid cross member with a first end that is coupled to the third portion of a first of the two rigid elements, and a second end that is coupled to the third portion of a second of the two rigid elements;

a soft material that defines a first surface coupled to a lower surface of the rigid cross member; and a bracket attached to a flat surface, wherein the bracket is contoured to define a pair of flat feet at opposite ends of the bracket and a raised mid-section between the feet, wherein the first portion of each rigid element is configured so that it can slide underneath the raised mid-section of the bracket.

* * * * *